United States Patent [19]

Peregudov et al.

[11] 4,162,159

[45] Jul. 24, 1979

[54] CAST IRON MODIFIER AND METHOD OF APPLICATION THEREOF

[76] Inventors: Lev V. Peregudov, ulitsa Puzakova, 39, kv. 231; Mikhail M. Malashin, ulitsa Liteizina, 74, kv. 30, both of Tula; Anatoly S. Naletov, ulitsa Novo-Cheremushkinskaya, 38, kv. 67, Moscow; Jury Y. Nenakhov, Scheglovskaya zaseka, dachny poselok, 3 proezd, 18, Tula; Evgeny A. Sokolov, 11 Parkovaya ulitsa, 54, korpus 1, kv. 35, Moscow, all of U.S.S.R.

[21] Appl. No.: 897,269

[22] Filed: Apr. 18, 1978

[51] Int. Cl.[2] ..... C22C 33/08

[52] U.S. Cl. ..... 75/130 R; 75/53; 75/134 N

[58] Field of Search ..... 75/53–58, 75/134, 130 R

[56] References Cited

U.S. PATENT DOCUMENTS

| | | | |
|---|---|---|---|
| 2,527,186 | 10/1950 | Griffiths | 75/57 |
| 2,980,529 | 4/1961 | Knapp | 75/57 |
| 3,099,552 | 7/1963 | Landig | 75/57 |
| 3,207,995 | 10/1963 | Katakura | 75/57 |
| 3,467,167 | 9/1969 | Mahin | 75/57 |
| 4,018,597 | 4/1977 | Staggers | 75/58 |
| 4,086,086 | 4/1978 | Dawson | 75/130 R |

*Primary Examiner*—P. D. Rosenberg
*Attorney, Agent, or Firm*—Fleit & Jacobson

[57] ABSTRACT

Cast iron modifier contains, in % by weight:

| | |
|---|---|
| silicon | from 30 to 40 |
| rare-earth elements | from 2 to 8 |
| calcium | from 10 to 20 |
| aluminum | from 15 to 30 |
| carbon | from 10 to 30 |
| sulphur | from 0.1 to 0.3 |
| iron | the balance, |

the above components being added to molten cast iron in the form of a mixture of alloys and cupola coke containing, in % by weight:

| | |
|---|---|
| silicocalcium | from 30 to 55 |
| silicomishmetal | from 5 to 25 |
| silumin | from 15 to 30 |
| cupola coke | from 10 to 30, |

the amount of the mixture added to cast iron being from 0.4 to 0.8% by weight.

The modifier enables the manufacture of thin-walled cast iron castings without formation of cementite on their surface.

3 Claims, No Drawings

CAST IRON MODIFIER AND METHOD OF APPLICATION THEREOF

BACKGROUND OF THE INVENTION

The invention relates to cast iron modifiers and method of their application in ferrous metal production, in particular for foundry.

Widely known in the art are cast iron modifiers used to reduce the formation of cementite on the surface of thin-walled cast iron castings.

Known in the art is a cast iron modifier disclosed in Japanese Pat. No. 48-43007 containing, in % by weight, rare-earth metals from 15 to 30, calcium from 10 to 20, aluminium from 5 to 7, and silicon—the balance.

However, the graphitization capacity which is determined by the rate of the formation of cementite on the surface of a production wedge-shaped sample does not enable the production of cast iron castings with a wall thickness from 5 to 10 mm without formation of cementite on the casting surface when casting in metal moulds.

A layer of white cast iron on the surface of a casting exhibits low mechanical properties so that such castings should be subjected to a high-temperature annealing in thermal furnaces to improve quality and ductility of castings.

High-temperature annealing is associated with considerable energy requirements so that the need to provide a modifier for cast iron which would permit castings to be produced with formation of cementite on the casting surface is urgent.

The provision of such cast iron modifier is, however, associated with a number of problems, while known modifiers and their application methods do not bring any solution to the problem.

High-temperature annealing of castings used heretofore after casting in metal moulds results in impaired physical and mechanical properties of castings as a result of formation of ferrite or ferrite/pearlite structure of cast iron. The absence of cast iron modifiers which would make it possible to manufacture thin-walled castings without formation of cementite on the surface of parts does not allow the reduction of power requirements, elimination of the employment of annealing furnaces, auxiliary equipments and operating staff.

SUMMARY OF THE INVENTION

It is the main object of the invention to provide a cast iron modifier which enables the manufacture of cast iron castings with a wall thickness from 5 to 10 mm in metal moulds without formation of cementite on the surface of castings.

Another, not least important object of the invention is to provide a method of application of the cast iron modifier which enables an improvement of quality of cast iron castings.

An important object of the invention is to reduce production cost in the manufacture of cast iron castings by eliminating high-temperature annealing, expensive equipment and materials, and by reducing the operating staff.

These objects are accomplished by the provision of a cast iron modifier containing silicon, rare-earth elements, calcium, aluminium and iron, wherein, according to the invention, there are additionally contained carbon and sulphur, said components being used in the following proportions, in % by weight:

| | |
|---|---|
| silicon | from 30 to 40 |
| rare-earth elements | from 2 to 8 |
| calcium | from 10 to 20 |
| aluminium | from 15 to 30 |
| carbon | from 10 to 30 |
| sulphur | from 0.1 to 0.3 |
| iron | the balance. |

With the content of silicon, calcium and aluminium below the specified limits, the process of graphitization of modified cast iron becomes unstable.

With the content of silicon, calcium and aluminium below the specified limits, physical and mechanical properties of modified cast iron are impaired.

The content of rare-earth elements such as cerium, below the specified limits does not enable the process of graphitization of cast iron to occur.

With an increase in the content of rare-earth elements above the specified limit, the content of free cementite in the cast iron structure materially increases.

With lower contents of carbon and sulphur in the modifier, the provision of required graphite crystallization centers during solidification of cast iron cannot be ensured.

With greater contents of carbon and sulphur, physical and mechanical properties of cast iron are impaired.

The above-mentioned components of cast iron modifier are preferably added to molten cast iron in the form of a mixture of alloys and cupola coke used in the following proportions, in % by weight:

| | |
|---|---|
| Silicocalcium | from 30 to 55 |
| Silicomishmetal | from 5 to 25 |
| silumin | from 15 to 30 |
| cupola coke | from 10 to 30. |

With the content of silicocalcium in the modifier below the specified limit, the specified silicon-to-calcium ratio in cast iron cannot be ensured.

An increase in the content of silicocalcium above the specified limit results in impaired physical and mechanical properties of modified cast iron.

With the content of silicomishmetal in the modifier below the specified limit, the specified silicon-to-rare-earth elements ratio cannot be ensured.

With the content of silicomishmetal above the specified limit, a material increase in formation of cementite on the surface of castings occurs.

With lower content of silumin against the specified limit, the graphitization process becomes unstable.

With an increase in the content of silumin, physical and mechanical properties, as well as casting properties of cast iron are impaired.

With lower content of cupola coke against the specified limit, the required graphite crystallization centers are not formed during solidification of cast iron.

With greater content of cupola coke against the specified limit, physical and mechanical properties of modified cast iron are impaired.

The modifier is preferably added to molten cast iron in an amount from 0.4 to 0.8% by weight.

If the modifier is used in an amount below the specified limit, thin-walled and chill castings cannot be obtained without formation of cementite on the surface of castings.

Adding the modifier to cast iron in an amount above the specified limit impairs physical and mechanical properties of modified cast iron and results in increased production cost.

DETAILED DESCRIPTION OF THE INVENTION

The invention will be better understood from the following examples of chemical composition of the modifier, and the tables give the method of application of the modifier according to the invention. In all examples, cerium is used as rare-earth element.

The modifier according to the invention contains, in % by weight:

| | Ex. I | Ex. II | Ex. III | Prior art the balance |
|---|---|---|---|---|
| silicon from 30 to 40 | 30 | 34 | 40 | 20 |
| rare-earth elements (cerium) from 2 to 8 | 8 | 15 | 2 | 20 |
| calcium from 10 to 20 | 10 | 14 | 20 | 15 |
| aluminum from 15 to 30 | 15 | 25 | 30 | 7 |
| carbon from 10 to 30 | 30 | 20 | 10 | — |
| sulphur from 0.1 to 0.3 | 0.3 | 0.2 | 0.1 | — |
| iron - the balance | the balance | | | — |

The modifier according to the invention exhibits high graphitization capacity.

This is due to the fact that carbon added to cast iron melt has no time to be completely dissolved, and the remaining solid particles initiate the formation of graphite inclusions. In addition, sulphur added to the modifier reacts with chemically active components thereof (rare-earth elements and calcium) to form refractory compounds, the particles of these compounds also initiating graphite crystallization. The use of the modifier by the method according to the invention provides for the above-mentioned ratios of components. In accordance with the invention, the modifier is added in the form of a mixture of silicomishmetal, silicocalcium, silumin alloy and cupola coke in the following amounts, in % by weight:

| | |
|---|---|
| Silicocalcium | from 30 to 55 |
| Silicomishmetal | from 5 to 25 |
| silumin | from 15 to 30 |
| cupola coke | from 10 to 30. |

Graphitization activity of the modifier is ensured by adding it in an amount from 0.4 to 0.8% by weight to molten cast iron.

For experimental preparation of the modifier, three mixtures of components were prepared, each containing, in % by weight, respectively, silicocalcium 30, 40 and 55, silicomishmetal 25, 15 and 5, silumin 15, 25 and 30, coke 30, 20 and 10. Cast iron was modified with each mixture. For control, similar cast iron was modified using a prior art modifier. The rate of formation of cementite on the surface of castings was determined from production wedge-shaped samples as compared with non-modified cast iron.

In the production samples, cast iron has the following amount of cementite formation (see the table):

| Modifier | Amount of modifier added (% by weight) 0.2 | 0.4 | 0.6 | 0.8 | non-modified cast iron |
|---|---|---|---|---|---|
| | Amount of cementite formation, mm | | | | |
| Prior art modifier | 5.4 | 4.3 | 3.2 | 2.6 | 16 |
| Example 1. Silicocalcium - 30%, silicomishmetal - 25%, silumin - 15%, coke - 30% | 1.5 | 0.2 | 0.0 | 0.5 | 16 |
| Example 2. Silicocalcium - 40%, silicomishmetal - 15%, silumin - 25%, coke - 20% | 1.8 | 0.8 | 0.0 | 0.0 | 16 |
| Example 3. Silicocalcium - 55%, silicomishmetal - 5%, silumin - 30%, coke - 10% | 2.5 | 1.4 | 0.0 | 0.0 | 16 |

This chemical composition of the modifier according to the invention and method of its application provide for graphitization activity higher than with the use of prior art modifiers for the manufacture of cast iron castings as can be seen from the above table.

With lower content of the modifier in cast iron, the desired reduction of cementite formation on the surface of castings cannot be obtained, while with an increase in the content of modifier, the amount of cementite formation on the surface of castings changes only slightly.

Higher graphitization capacity of the modifier according to the invention permits thin-walled cast iron castings to be manufactured without formation of cementite on the surface thereof thus improving their machining, eliminating the need in graphitization annealing and lowering the production cost of castings.

What we claim is:

1. A cast iron modifier containing, in % by weight:

| | |
|---|---|
| silicon | from 30 to 40 |
| rare-earth elements | from 2 to 8 |
| calcium | from 10 to 20 |
| aluminium | from 15 to 30 |
| carbon | from 10 to 30 |
| sulphur | from 0.1 to 0.3 |
| iron | the balance. |

2. A method of application of a modifier containing in % by weight:

| | |
|---|---|
| silicon | from 30 to 40 |
| rare-earth elements | from 2 to 8 |
| calcium | from 10 to 20 |
| aluminum | from 15 to 30 |
| carbon | from 10 to 30 |
| sulphur | from 0.1 to 0.3 |
| iron | the balance, |

comprising adding the components of said modifier to molten cast iron in the form of a mixture of alloys and cupola cake used in the following proportions, in % by weight:

| | |
|---|---|
| silicocalcium | from 30 to 55 |
| silumin | from 15 to 30 |
| cupola coke | from 10 to 30. |

3. A method according to claim 2, wherein said modifier is added to molten cast iron in an amount from 0.4 to 0.8% by weight.

* * * * *